United States Patent [19]

Ecker et al.

[11] Patent Number: 4,520,728

[45] Date of Patent: Jun. 4, 1985

[54] METHOD OF OPERATING A PRINTING PRESS AND APPARATUS

[75] Inventors: Harold Ecker, DePere; Harvey J. Spencer, Green Bay, both of Wis.

[73] Assignee: Paper Converting Machine Company, Green Bay, Wis.

[21] Appl. No.: 620,539

[22] Filed: Jun. 15, 1984

Related U.S. Application Data

[63] Continuation of Ser. No. 350,627, Feb. 22, 1982, abandoned.

[51] Int. Cl.[3] ..... B41F 13/12

[52] U.S. Cl. ..... 101/248; 101/426

[58] Field of Search ..... 101/178, 248, 181, 174, 101/212, 216, DIG. 12, 177, 179, 180, 183, 184, 136, 137, 138, 139, 140, 141; 33/184.5

[56] References Cited

U.S. PATENT DOCUMENTS

| | | | |
|---|---|---|---|
| 3,042,996 | 7/1962 | Nelson | 101/248 X |
| 4,362,098 | 12/1982 | Stelling, Jr. | 101/351 X |
| 4,413,560 | 11/1983 | Rogge | 101/247 |

FOREIGN PATENT DOCUMENTS

| | | | |
|---|---|---|---|
| 2362727 | 3/1978 | France | 101/178 |
| 280081 | 11/1927 | United Kingdom | 101/248 |

*Primary Examiner*—J. Reed Fisher

[57] ABSTRACT

A register assembly including sleeve and collar means and gearing which can be adjusted relative to each other off-machine and to a predetermined position on the plate cylinder journal or shaft so that when the register assembly is mounted on the plate cylinder journal, the plate cylinder not only has exact gear tooth engagement but also proper registration.

15 Claims, 18 Drawing Figures

FIG. 1
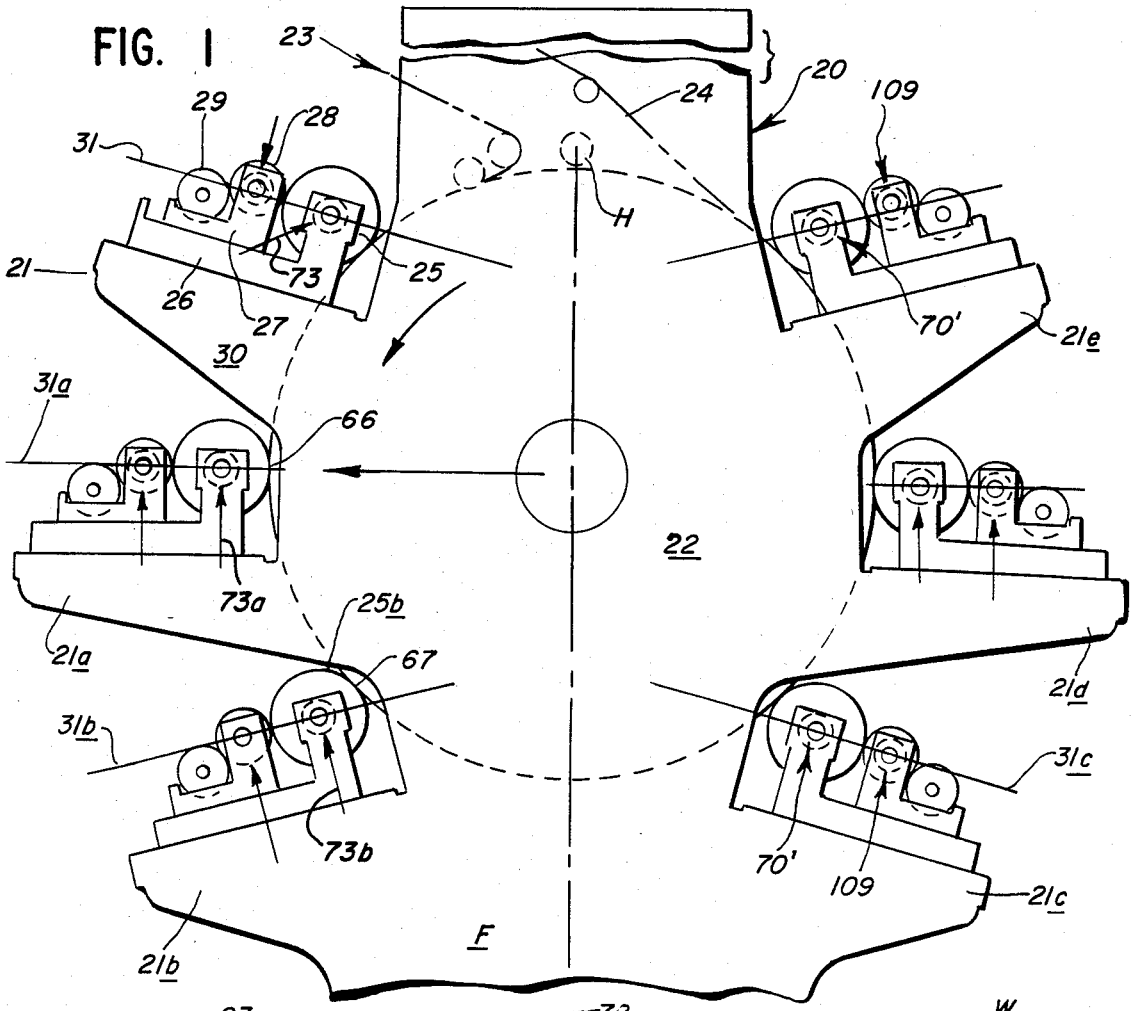
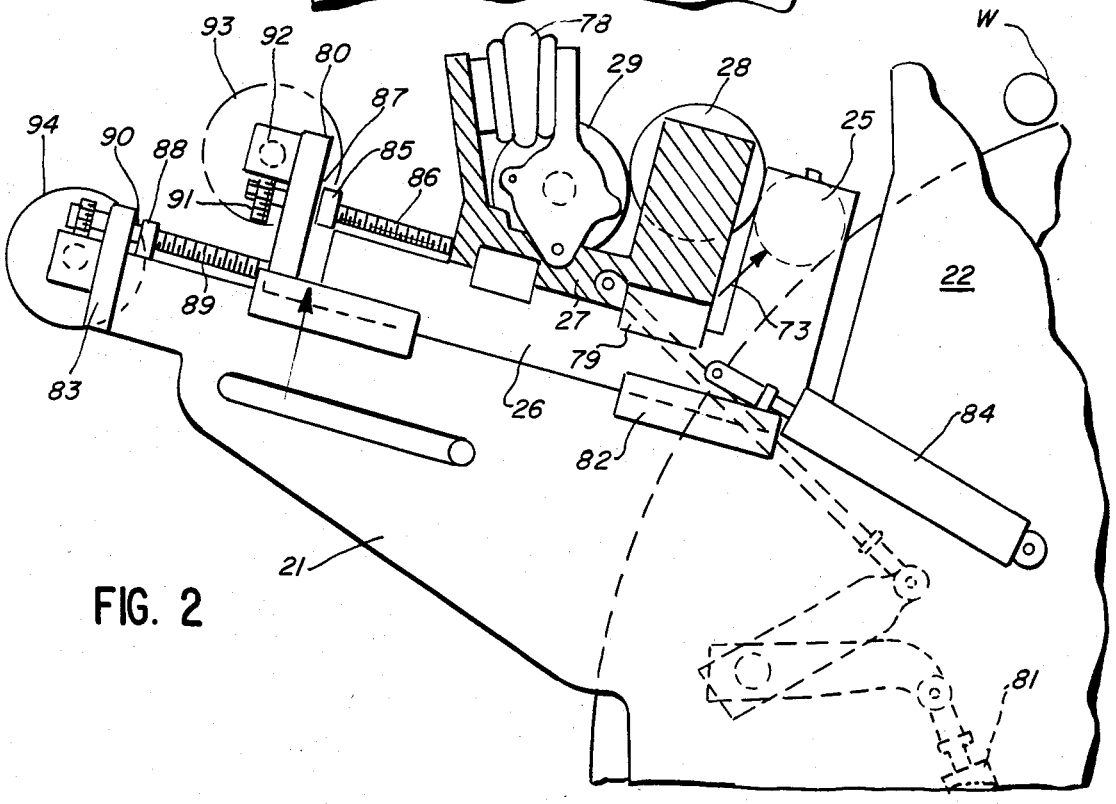
FIG. 2

FIG. 6
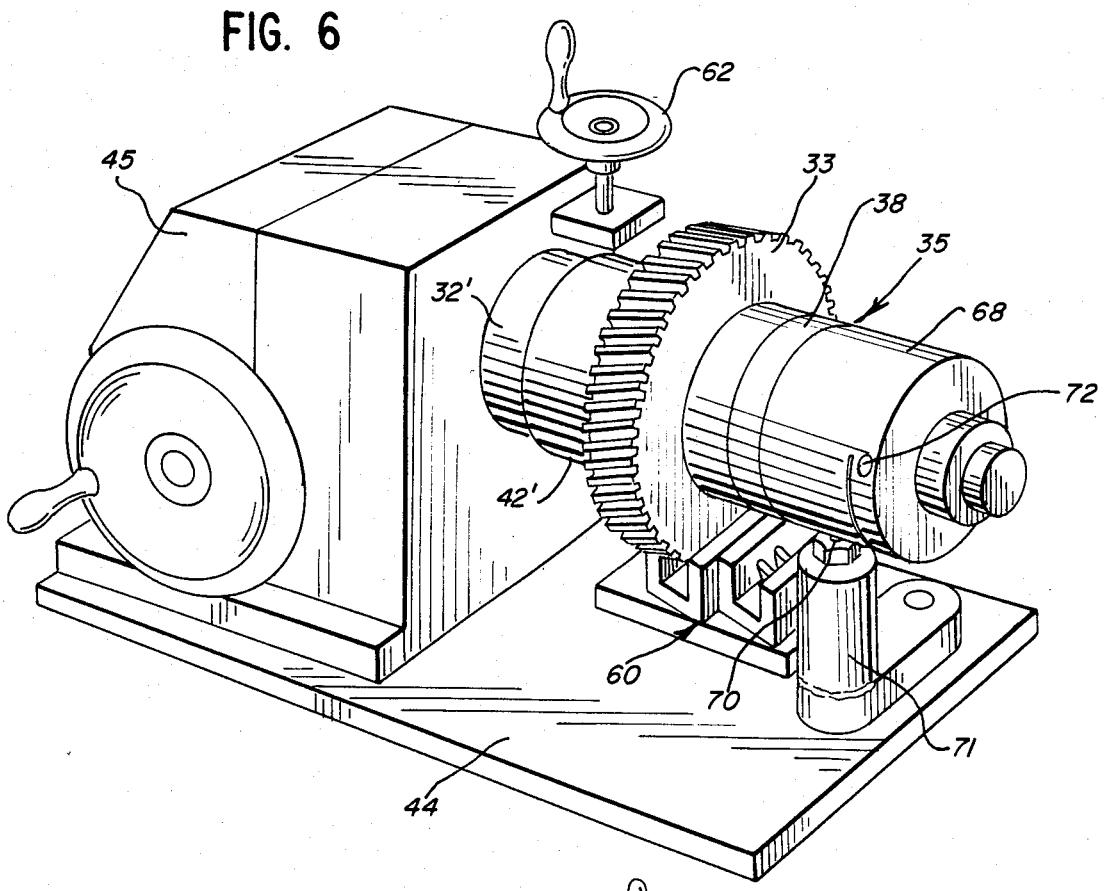
FIG. 7
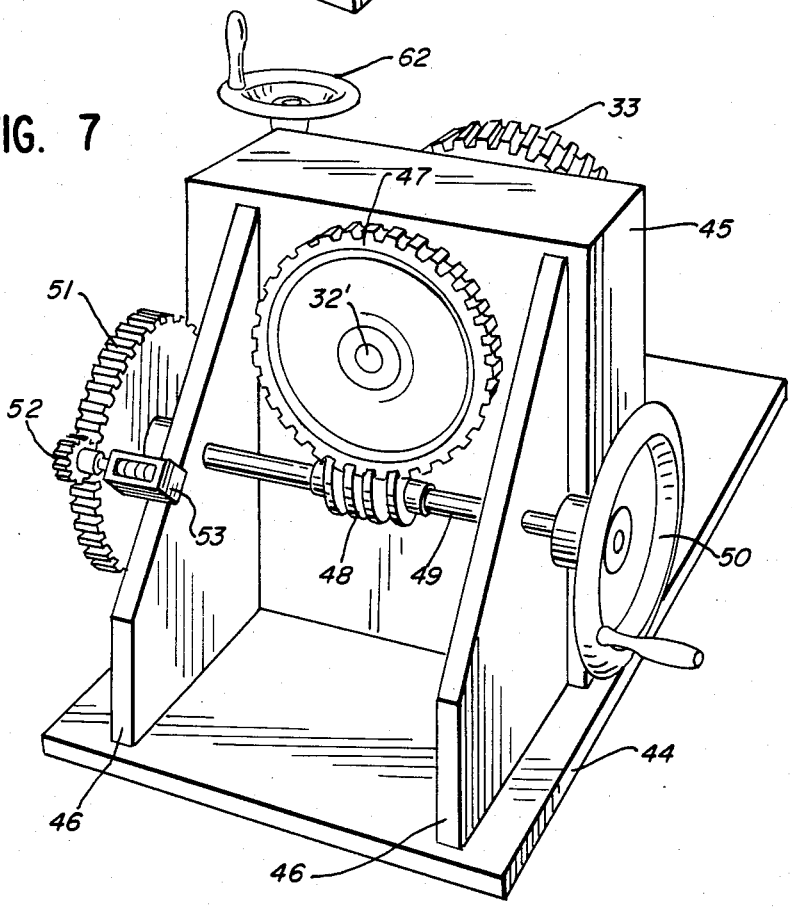
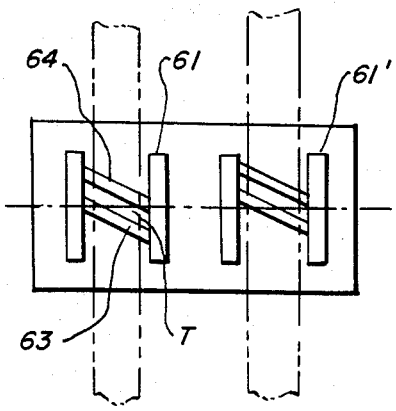
FIG. 8

FIG. 11
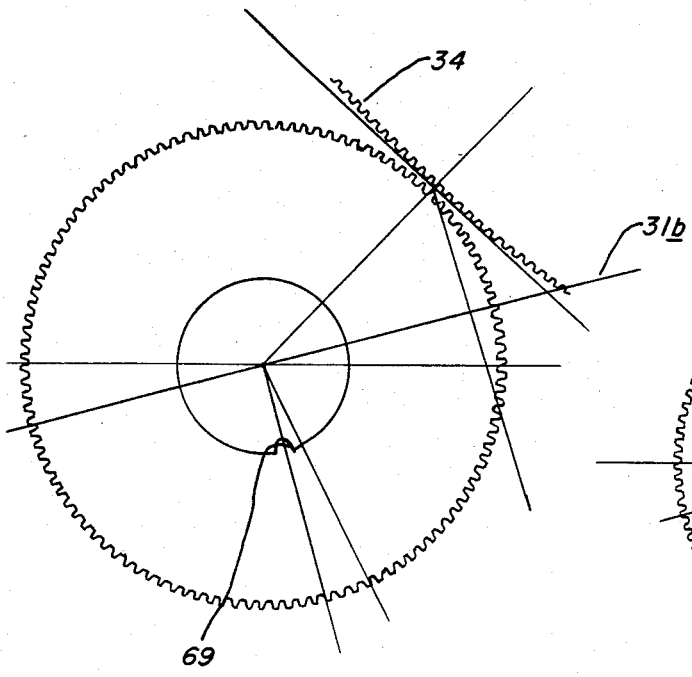
FIG. 12
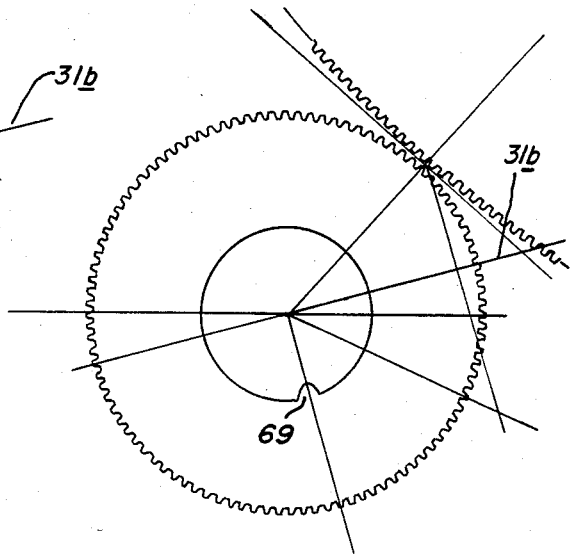
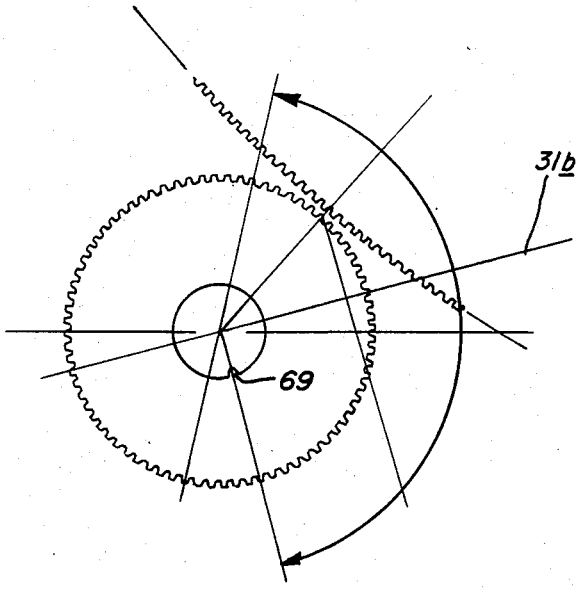
FIG. 13
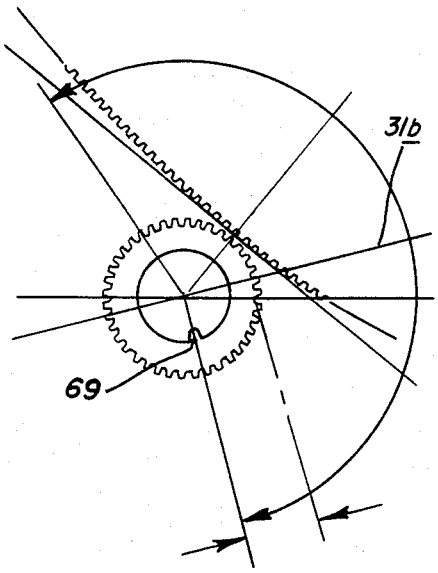
FIG. 14

METHOD OF OPERATING A PRINTING PRESS AND APPARATUS

This application is a continuation of U.S. application Ser. No. 06/350,627, filed Feb. 22, 1982, now abandoned.

BACKGROUND OF THE INVENTION

This invention relates to a method of operating a printing press and apparatus therefor and, more particularly, to a press employing a central impression cylinder with a plurality of print decks disposed about the periphery thereof.

Illustrative of the art to which the invention applies is co-owned U.S. Pat. No. 3,041,967. There the central impression cylinder receives ink impressions (generally different colors) from six different print decks, arranged three on a side as is relatively commonplace in this phase of the printing art. Normally, each deck includes a plate cylinder arranged to impress a particular pattern on the web carried by the impression cylinder. The ink, i.e, color, is transferred to the plate cylinder which carries the plate embodying the desired pattern by means of a transfer cylinder, commonly referred to an "anilox roll". This anilox roll, in turn, derives the ink from a fountain roll operating in or in conjunction with a source of ink. Thus, there is an arrangement of three rolls in each deck for developing the pattern or "repeat" as is commonly referred to in the art. The above mentioned patent deals with a mechanism for bringing these various deck cylinders into contact so as to achieve the printing. This, however, is a relatively minor problem when compared with the problem faced by the art in changing the plate cylinders. It will be appreciated that every time the "repeat" is to be changed, the plate cylinder itself has to be changed. The major problem that arises in this transition is that of achieving register of the various colors or patterns. Often, a large, expensive machine may be inoperative for an hour or two while the pressman are adjusting the various decks to achieve registration.

The difficulty of achieving registration according to contemporary technique can be appreciated from the following typical sequence. The first step has been to install plate cylinders in all of the 6 decks. These are normally arranged three on a side with the first deck being at the 10:30 o'clock position, the second at 9 o'clock, the third at 7:30 o'clock, the fourth at 4:30 o'clock, the fifth at 3:00 o'clock and the sixth at 1:30 o'clock. The sequence of achieving register normally starts with the No. 1 deck where the pressman hits two buttons to bring the data cylinder and the anilox roll almost into gear mesh. It will be appreciated that conventionally the central impression cylinder is equipped with a large gear usually called a "bull" gear which in turn drives a gear train for the plate and transfer cylinders in each deck, these gears being arranged in tandem. Thus, the first step is to almost engage the anilox roll gear with the place cylinder gear and the plate cylinder gear with the bull gear. To achieve gear meshing, the gear on the plate cylinder is "inched" in small increments until proper mesh is achieved with the teeth on the bull gear. It also should be appreciated that these are helical gears—necessitated for fine adjustment—so that gear tooth meshing is not readily preceived visually. In the same fashion, the anilox roll gear is inched into meshing relation with the plate cylinder gear. Thereafter, the rolls of the No. 1 deck are locked in position and inched into impression position. This is normally determined by inserting a 0.125" inch gauge between the surface of the plate cylinder and the surface of the central impression cylinder—and this is required along both sides of the web, i.e., at each end of the plate cylinder. The same feeler gauge activity is performed on the ends of the anilox roll so as to bring it into proper impression position. Thereafter, a register mark is placed on either the impression cylinder or web, as desired. In some instances, both are employed because, although the register mark is much more visible on the web, it might slip relative to the impression cylinder.

The next sequence of steps involve indexing the impression cylinder until the register marks lines up with the tangent point of the No. 2 plate cylinder relative to the central impression cylinder.

Next, the plate cylinder and anilox roll of the No. 2 deck are brought into almost meshing relation and then inched into impression position utilizing the feeler gauge procedure described above. At this point, the plate cylinder is not locked to its gear so that the plate cylinder can be rotated until it is in register with the previously put down register mark, i.e., the pattern on the No. 2 deck plate cylinder is in congruence with the pattern provided by the No. 1 deck plate cylinder. Then the plate cylinder gear is locked relative to the plate cylinder. This same sequence of steps performed relative to the No. 2 print deck has to be performed with respect to the remaining print decks, i.e, decks 3 through 6 and it will be appreciated that at each stage, visual inspection of the printed pattern must be made to insure that each of the impressions provided by the six decks is in proper register. This has proved to be time-consuming and wasteful of the productive capacity of large, high speed presses. This is particularly true when short "runs" are made because the changeover from one run to another requires going through the laborious changeover procedure just described.

The obvious solution to the laborious registration procedure is to provide register marks on the central impression and plate cylinders beforehand corresponding to a given repeat. However, this has not proven successful in practice probably because of the difficulty of utilizing the large number of marks necessary to cover the spectrum of "repeats". Also, the gear teeth are relatively small and because it is difficult to discern misalignment of the order of a quarter or half degree, very often the wrong gear teeth are engaged. In this connection, it should be appreciated that the gearing is helical rather than conventional spur gears which further complicates the problem of making sure that right gear tooth is selected for engagement with the correct "valley" in mating gear so as to bring the proposed register marks into alignment. The aligned register mark expedient was suggested in Fresch Pat. No. 76 26719 but to the best of applicant's knowledge, this has not been adopted in practice. The teaching of the French patent is that the register marks on the plate cylinder and central impression cylinder should be in line after the gear teeth have been brought into engagement. This really does not address the problem because it is difficult to know which helical tooth should be selected beforehand so as to bring about the alignment after the helical teeth have meshed.

SUMMARY OF THE INVENTION

The invention solves the foregoing problem by orienting the plate cylinder gear to a predetermined orientation and while the same is "off" the machine. This eliminates the substantial "down time" that is characteristic of contemporary practice while registration is sought and also provides a regulated or controlled atmosphere in which the adjustment or orientation can be made. Further, it can be done with such exactitude that when the plate cylinder gear is mounted on the plate cylinder, the plate cylinder gear can be brought into meshing relation with the bull gear by linear movement of the print deck only and without the disturbing and uncontrolled axial movement proposed in other expedients, as in the above-identified French patent.

More particularly, the inventive method utilizes a register assembly including sleeve and collar means and gearing which can be adjusted relative to each other off-machine and to a predetermined position on the plate cylinder journal or shaft so that when the register assembly is mounted on the plate cylinder journal, the plate cylinder not only has exact gear tooth engagement but also and, most importantly, proper registration. Here it should be appreciated that there is always "fine tuning " of the registration after the press has started operating by virtue of minor adjustments of the rotary positions of the various plate cylinders made possible by means of axially sliding the helical gears one relative to another. This is where the artistry of the pressman comes into play so that the desired registration need only be such as to permit the pressman to finish the registration procedure by a minor shaft of the various helical gears.

The invention is explained in conjunction with the accompanying drawing, in which FIG. 1 is a side elevational view somewhat schematic of a six color flexographic press such as would be employed in the practice of the invention;

FIG. 2 is a fragmentary side elevational view in partial section showing the plate cylinder mounting assembly and remainder of mechanism employed for deck positioning;

FIGS. 6–8 are perspective views of the register assembly components;

FIGS. 11–14 are schematic side elevational views of the gearing involved for different repeats on the plate cylinders;

DETAILED DESCRIPTION OF THE INVENTION

Figure 3:
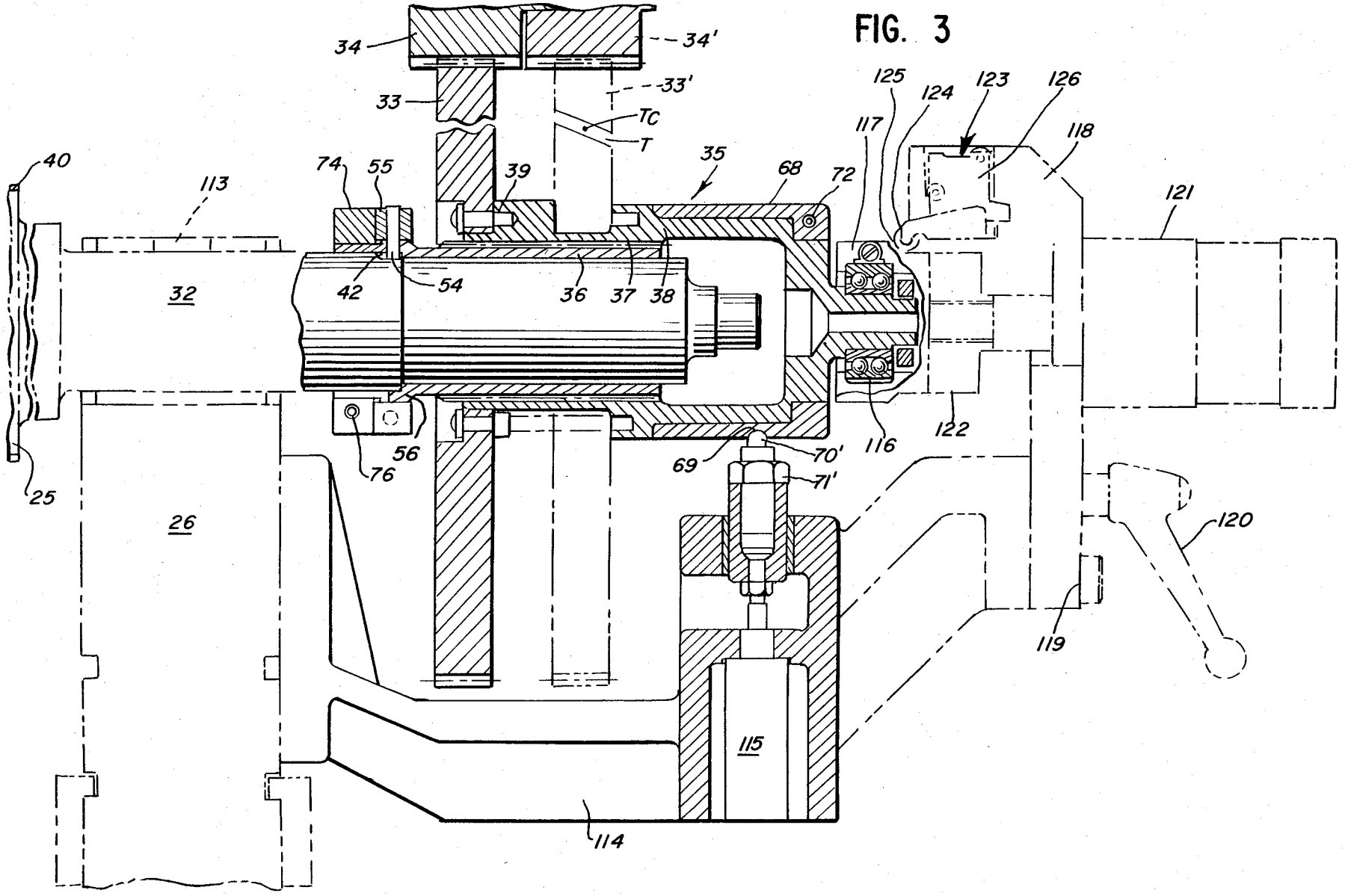
FIG. 3 is a side elevational view partially in section and partially in phantom line of the plate cylinder, register assembly and associated press components.

The central impression printing section 20 of FIG. 1 is typically arranged with six printing decks 21 and 21*a* through 21*e* arranged symmetrically about the central impression cylinder 22. The apparatus is supported on a conventional frame F. An incoming web 23 is placed on the surface of, and remains in intimate contact with the surface of the central impression cylinder 22 as it rotates past the six color decks 21–21*e* and finally exits as at 24. Between color dryers are often used (for example between color decks 21 and 21*a*, etc.) but are not shown for purposes of clarity. Each color deck assembly is comprised of like elements including plate roll cylinders 25 each mounted on a movable sub-frame 26 which supports a bracket 27. The bracket 27 is independently movable from sub-frame 26 and supports an anilox roll 28 and a fountain roll 29. Each frame 27 also supports an ink fountain (not shown) mounted directly below each fountain roll 29. Further details on the individual deck construction are shown in FIG. 2. Inasmuch as each color deck embodies the same elements, each element has been given the same numeral. Where a distinction is required between the elements of different decks, the numeral will be suffixed by the appropriate letter—as for example the plate roll cylinder of deck 21*b* (at the 7:30 o'clock position in FIG. 1) is designated 25*b*.

Each sub-frame 26 and hence its associated bracket 27 is mounted on frame extension 30 and is movable relative thereto. In the first printing deck 21, this movement will be along line 31 and, the other decks along counterpart lines—for example, line 31*c* for deck 21*c*.

The operation and mechanism associated with the linear movement of the various deck cylinders into impression position will be described hereinafter and with respect to FIG. 2. Turning now to FIG. 3, a sectional view in fragmentary form of the plate cylinder 25 is seen along with the associated mechanism for operating the same.

The plate cylinder 25 has a journal or stub shaft 32 formed integrally therewith and which is normally employed for carrying the gearing which rotates the plate cylinder in synchronism with the central impression cylinder 22. For example, the numeral 33 designates the helical gear associated with the plate cylinder 25 while the numeral 34 designates a portion of the bull gear fixed to the central impression cylinder 22. Shown in dotted line and designated 33' and 34' are another pair of gears associated, respectively, with the plate cylinder and central impression cylinder for a slightly different operation. Conventionally, flexographic presses are equipped with 10 pitch (diametral) gears and one-quarter pitch circular gears. The gears are not too different but make for a different type of repeat operation as is conventional in the art.

Interposed between the journal 32 and the bull gear 34 and carrying the plate cylinder gear 33 is a register assembly generally designated 35. This is removably mounted on the journal 32 and can be arranged in a desired condition or configuration away from the machine so as to materially speed up the changeover or set up time for a different repeat. For example, the color-to-color registration procedure currently employed often involves from 15 to 30 minutes per color. With from approximately 1½ to 3 hours or more of set-up time and lost production involved in the state of the art set-up time, the inventive procedure can substantially increase press up-time by allowing off-machine setup while the press is operating.

The register assembly 35 includes a number of elements cross hatched in FIG. 3 and which are essentially concentrically related to each other. Innermost is a sleeve 36 which is slidable mounted on the journal 32 and which is supplied with an external spline as at 37—see also the right hand portion of FIG. 4.

Figure 4:
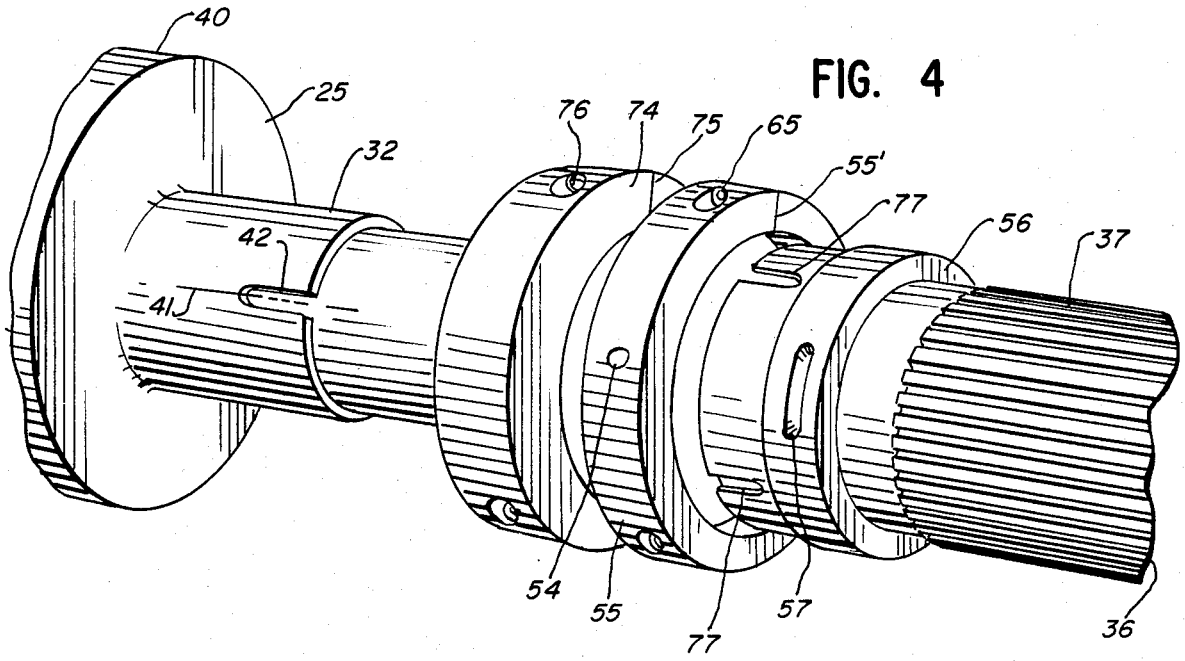
FIG. 4 is a perspective view of the register assembly.

FIG. 4 depicts a perspective somewhat exploded version of the register assembly 35 and the journal 32—the latter being seen in fragmentary form at the extreme left hand portion of FIG. 4. FIG. 4 is concerned primarily with the left hand end portion of the register assembly and hence the gears and certain of the concentric elements are omitted therefrom.

Returning now to FIG. 3, the numeral 38 indicates a second sleeve and which is equipped with an internal spline so as to mate with the external spline 37 on the first mentioned sleeve 36. Thus, movement of the sleeve 38 relative to the sleeve 36 is constrained to the axial direction and is employed when the machine is set-up for the purpose of making fine adjustments in register. For example, the registration employed by the inventive method centers the gear 33 axially within the gear 34. Sliding movement of the collar 38 relative to the collar 36 moves the gear 33 to the right or left, as the case may be—and because the gears 33 and 34 are helical gears—will result in a slight rotation of the plate cylinder 25 relative to the central impression cylinder 22 (because the latter has the bull gear 34 affixed thereto and there is no relative rotational movement between the gears 33 and 34). The gear 33 can be seen to be removably mounted on the collar 38 by means of the bolts 39.

The specific object of the invention is to orient the register assembly, particularly the gear 33 relative to a reference point off the machine that will permit the register assembly 35 to be installed relative to a similar reference point on the plate cylinder and thus have a preselected tooth on the gear 33 enter a preselected valley between teeth on the bull gear 34. As indicated previously, this is virtually impossible to do visually on the machine as by aligning reference points such as scribe lines on the plate and central impression cylinders or the gears associated therewith. The gears are relatively fine toothed and, in this instance, the teeth are helical along an 18 degree angle which makes matching visually virtually impossible. The discussion immediately following deals with the orientation of the register assembly 35 so as to have the proper tooth on the gear 33 in position for exact engagement with a predetermined valley between teeth on the bull gear 34. Subsequently, the steps employed for properly locating the bull gear will be discussed.

With reference to the proper positioning of the plate cylinder and its register assembly 35, it first should be appreciated that the plate cylinder is equipped with a plate 40 (see FIG. 3) which is precisely positioned on the plate cylinder relative to an imaginary scribe line. In the instant case, the scribe line can be considered the line 41 (see the left hand portion of FIG. 4) which bisects the keyway 42 in the shoulder of journal 32. The keyway is also seen in the central left hand portion of FIG. 3. The object, as expressed somewhat differently above, is to locate the precise tooth needed for pattern registration in exact alignment with the imaginary scribe line 41, i.e., the keyway 42. More precisely, it is desired to have the center of mid-point of the helical tooth so aligned so as to permit the fine adjustment previously referred to. The matter of the orientation of the plate cylinder gearing is further complicated by the fact that the various decks **21–21*e* have different angular relationships to the center of the central impression cylinder 22 so that a phase difference exists between the various decks. Inasmuch as the ultimate object is to have the various cylinders of the various decks oriented properly so that they all can be substantially simultaneously brought into printing engagement, provision must be made for this phase differential. Before going into that, however, it is believed helpful to the understanding of the invention to discuss the No. 2 deck, i.e., deck 21*a* where the phase angle can be considered zero. It will be appreciated that with respect to this deck, the line of movement along line 31*a* (see FIG. 1—the center left hand portion) passes through the center of the central impression cylinder 22**.

Figure 5:
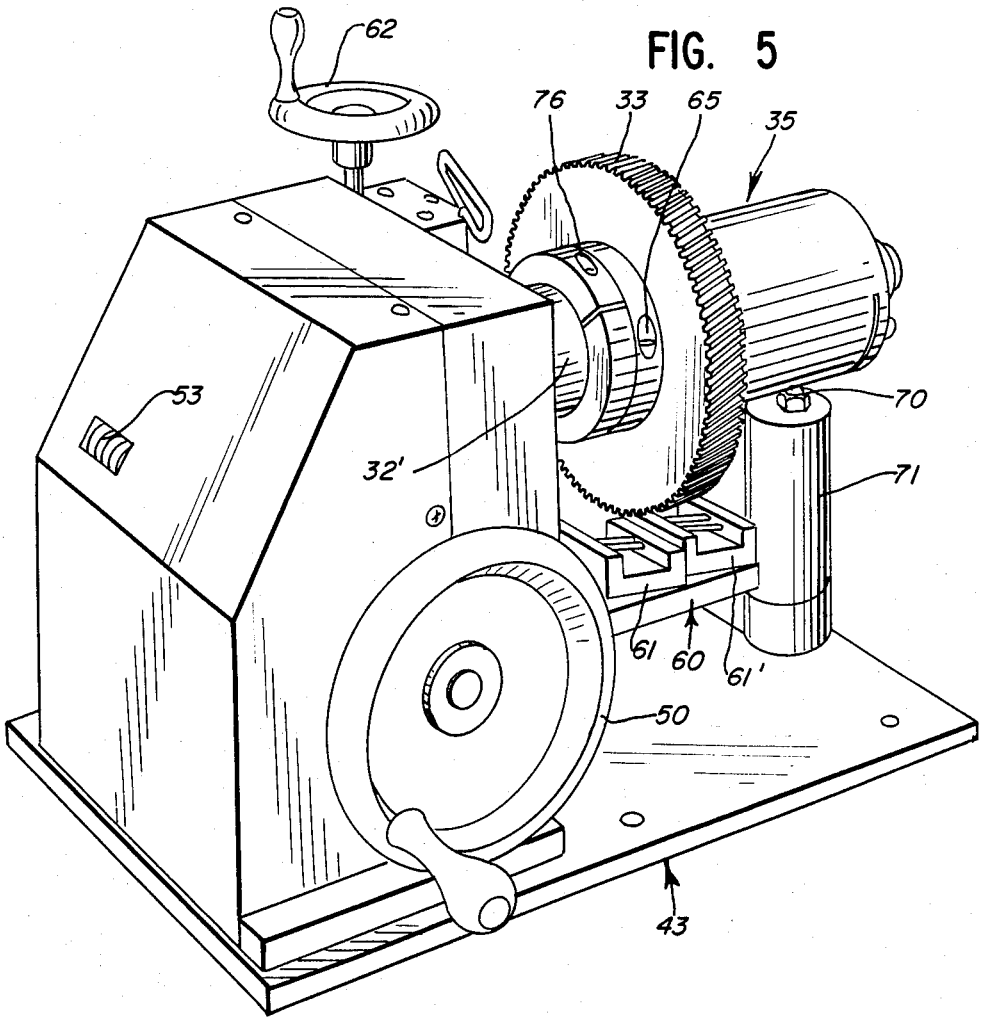
FIG. 5 is a perspective view of the set-up fixture for the register assembly.

To orient the register assembly 35 associated with the plate cylinder of each deck, the elements at the left hand portion of the register assembly 35 as seen in FIGS. 3 and 4 are used in conjunction with a set-up fixture seen in FIG. 5. The set-up fixture is generally designated 43 and can be seen in various aspects in FIGS. 6–8 as well.

The fixture 43 includes a base 44 (see particularly FIG. 6) and mounted thereon a pedestal 45. The pedestal is equipped with a bearing (not shown) which supports a dummy or stub shaft 32' corresponding to the plate cylinder shaft 32 and which is equipped with a similar keyway 42'—facing downwardly in FIG. 6. Removably mounted on the shaft 32' is the register assembly 35.

Referring now to FIG. 7 which is a perspective view of the fixture 43 but from the opposite side from that seen in FIG. 6, and with cover removed, the numeral 46 designates a pair of brackets interposed between the base 44 and the pedestal 45 for the purpose of supporting mechanism to turn the shaft 32'. For this purpose, the shaft 32' is equipped with a worm gear 47 which cooperates with a worm 48 carried on worm shaft 49. The shaft at the right hand end (as seen in FIG. 7) is equipped with a hand wheel 50 so that upon turning the band wheel the worm and worm gear cooperate and rotate the shaft 32' and hence the register assembly 35.

At the left hand end (as seen in FIG. 7) the worm shaft 49 is equipped with a counter drive gear 51 which is in meshing engagement with a counter driven gear 52. The gear 52 is provided as part of a counter assembly 53 mounted on one of the brackets 46. Thus, the angular rotation of the stub shaft 32' is reflected in the digital counter 53.

In the operation of the fixture 43, the digital counter 53 is set at zero and in this condition the hand wheel 53 is oriented so as to position the keyway 42' of the shaft 32' in the downwardly facing position. Thereafter, the register assembly 35 is slid onto the shaft 32' by sliding the sleeve 36 axially of the shaft and with the pin 54 of the collar 55 (see FIG. 3) generally aligned with the keyway 42'. Reference to the left central portion of FIG. 3 reveals that the sleeve 36 at the end adjacent the plate cylinder 25 rotatably carries the collar 55 which in turn is equipped with the pin 54. This can be appreciated more readily from a consideration of FIG. 4 where the sleeve 35 is seen to be equipped with a radial enlargement 56. It is this enlargement which rotatably supports the collar 55. The pin 54 extends through the radial enlargement 56 so as to enter the keyway 42' and for this purpose, the radial enlargement 56 is equipped with an arcuate slot 57 (see the central part of FIG. 4).

After the register assembly 35 has been ensleeved on the stub shaft 32', and with the pin 54 extending into the keyway 42', exact positioning of a preselected tooth of the gear 33 is undertaken. What is meant by the center of the tooth can be appreciated from the upper central portion of FIG. 3 where the center of a particular tooth T is designated $T_c$. The object of this phase of the inventive method is to orient the center $T_c$ of a particular tooth T in exact alignment with the imaginary scribe line 41 so that upon translation of the plate cylinder 25*a* toward the central impression cylinder 22 (see the right central portion of FIG. 1), the gear teeth of the bull gear and plate cylinder gears will mesh precisely.

For that purpose, the fixture 43 is equipped with a gauging block assembly generally designated 60. More particularly, a pair of gauging blocks 61 and 61' are provided for use with the two gears 33 and 33'—only one of which is used in a particular installation. It will be appreciated that the central impression cylinder 22 is equipped with a pair of bull gears having different tooth configurations as mentioned previously and when one bull gear as at 34 is chosen for the operation of the press, the plate cylinder gear 33 is employed and this is gauged by the gauging block 61.

The gauging block 61 is mounted on the assembly 60 for vertical movement through a gear train and linkage system (not shown) but which is operated by the second hand wheel 62 (see the upper portions of FIGS. 6 and 7). As the gauging block 61 is elevated by turning the second hand wheel 62, the gear 33 is "jockeyed" into precise position between the positioning struts 63 and 64 of the gauge blocks 61. This is permitted in the register assembly 35 by virtue of the arcuate slot 57 (see the central part of FIG. 4). More particularly, the gear 33 (see FIG. 3) is fixedly related to the sleeve 36 by virtue of the splined interconnection between the sleeve 38 carrying the gear 33 and the sleeve 36. On the other hand, the collar 55 is fixed in position by virtue of the pin 54 thereof being confined in the keyway 42'. Slight angular movement of the gear 33 by virtue of the slot 57 in the sleeve 36 is possible so that during the upward movement of the gauge block 61, the tooth T can be simultaneously engaged by the struts 63 and 64 until the block 61 moves to the end of its upward travel—at which time the struts 63 and 64 are fully seated in the valleys flanking the tooth T. At this stage, the center $T_c$ of the tooth T is precisely aligned with the imaginary scribe line 41. Thereafter, the lock bolt 65 (see FIG. 4) of the collar 55 is tightened so as to clamp the collar 55 immovably on the radial enlargement 56 of the sleeve 36. This is achieved by virtue of the collar 55 being split as at 55' (see the central part of FIG. 4).

As indicated previously, if the register assembly 35 is the one to be installed on the second deck plate cylinder 25*a*, no further manipulations would be required. However, this is not true for the plate cylinders of the remaining decks which have different phasing. This can be best appreciated from a reference to FIG. 1.

In FIG. 1, and relative to the second deck, i.e., the deck 21*a*, the point of tangency 66 is seen to lie on the line of deck movement 31*a*—the point of tangency 66 being the impression point between the plate cylinder 25*a* and the central impression cylinder 22. However, the situation is different as exemplified by the third deck 21*b*. There the point of tangency 67 is angularly offset from the line of deck movement 31*b* and to insure that a particular tooth on the plate cylinder gear falls between teeth of the bull gear 34, the plate cylinder must be rotated out of alignment with the scribe line 41. If it were not, it would be translated along the line of deck movement 31*b* and thus not mate with the associated valley between teeth of the bull gear. The needed rotation can be precisely determined trigonometrically. One of the factors requiring the rotational adjustment of the gear 33 is the fact that the line of movement 31*b* of the third deck is at 15 degrees to the horizontal and, as is clearly apparent from FIG. 1, does not pass through the center of rotation of the central impression cylinder 22.

An additional complication arises because of the non-alignment of the centers of the plate cylinder 25*b* and the center of the central impression cylinder 22. This means that as the teeth of the gears of these respective cylinders engage, there is an additional slight angular rotation of the plate cylinder between engagement and full seating—of the order of about 1½ degrees. Again, this can be calculated with precision beforehand. Thus, from the geometry and using trigonometric functions, the precise angular rotation or "phasing" of the gear associated with the plate cylinder 25*b* can be predetermined and this is introduced into the setup fixture 43 by turning the hand wheel 50 so that the digital counter 53 reflects the precise angular phasing desired. More particularly, with collar 55 clamped onto the sleeve 36, the gauge block 61 is elevated to its up position so as to engage the tooth T. Then the hand wheel 50 is turned to rotate the register assembly 35 to the orientation desired as reflected by the counter 53. The particular tooth T needed to be positioned at the point of tangency 67 is now in that position and I provide a locking collar with detent means for maintaining that position before the register assembly is removed from the fixture 43 and installed on the shaft 32 of the particular plate cylinder involved.

Referring now to FIG. 3, the register assembly at its right hand end is seen to be equipped with a further collar 68 which is rotatably mounted on the sleeve 38. The collar 68 is equipped with a detent 69 (see the bottom right hand portion of FIG. 3) which can be rotated into alignment and engagement with the rounded end of the plunger shaft 70 (see FIG. 6). A plunger device 71 is pivotally mounted on the base 44 and is swung into position in general alignment with the detent 69 and as the collar 68 is rotated the "ball" end of the shaft enters the detent 69. A portion of the collar 68 is split and equipped with a lock bolt 72 (see also the right hand end of the FIG. 3) which is tightened so as to clamp the collar 68 fixedly to the sleeve 38. I have thus provided a reference detent to orient the particular tooth T (as well as coincident key 42 and imaginary line 41) in a predetermined angular position relative to the detent.

A similarly constructed plunger is provided on the frame F for each deck 21, 21*a*, etc. This plunger is indicated schematically by an arrow 73 in the upper right hand portion of FIG. 2 and relative to the first deck 21. Thus, for each plate cylinder of each deck, the fixed plunger device associated with each deck is used to hold detent 69 in a reference position so that scribe line 41, key 42 and a particular tooth T are in the proper angular relationship relative to the detent 69 engaged at the reference 73. Thereafter, the plate cylinder equipped with the register assembly 35 (preset to the same predetermined angle) is installed in the subframe 26 and rotated until the "ball" of the frame plunger reference 73 engages the detent 69. After the teeth of the gears 33 and 34 have become fully engaged, the plunger device is then activated out of engagement with the detent 69 by cylinder 115.

Exact gear mesh and registration (subject to the small fine tuning by the pressman during actual operation) is thus provided by the inventive method. The plate 40 of the plate cylinder 25 (see FIG. 3) is precisely positioned on the plate cylinder scribe line 41 (see FIG. 4). The register assembly 35 is also precisely positioned relative to the scribe line 41 by virtue of the pin 54 (see FIG. 4) entering the keyway 42 associated with the journal of the plate cylinder. After the pin 54 has been seated within the keyway 42, a further collar 74 (see FIG. 4) is tightened to hold the assembly on the plate cylinder journal. The collar 74 is a split collar as at 75 (see FIG. 4) and is equipped with a lock nut 76. This is loosely mounted on the extreme left hand or inner end of the sleeve 36. The sleeve 36 has slotted cutouts as at 77 so that when the lock nut 76 of collar 74 is tightened, collar 74 clamps the slotted end of sleeve 36 to journal 32. Thus, the register assembly and most importantly, gear 33, coincident key 42 and scribe line 41 are in a fixed angular relation to the plate 40 of the plate cylinder 25. With the particular tooth T and coincident scribe line 41 in a predetermined angular relation to the frame reference 73, the plate cylinder can be translated along the line of movement 31, 31*a*, etc., to bring about engagement of preselected teeth of coacting central impression cylinder and plate cylinder gears with proper orientation of each plate cylinder to achieve registration between all decks.

Exemplary of the variety of repeats utilized in flexographic printing are the showings of FIGS. 11–14. In all of the four views, the bull gear 34 (see FIG. 11) is a ten diametral pitch 600 tooth gear. The plate cylinder gears are for different repeats and are in the position they would occupy in the third deck, viz., deck 21*b* where the line of movement has been designated 31*b*. The examples of FIGS. 11–14 represent the actual installation where the detent 69 has been oriented at 90 degrees to the line of movement 31*b*. Locating the plunger device 73 at the bottom of the register assembly 35 rather than obtusely relative to its line of movement is a matter of design choice and convenience for deck 21*b*.

Thus, in set-up and subsequent plate cylinder installation, the gear tooth T, keyway 42, and scribe line 41 will be angularly rotated relative to reference 73, said rotation taking into account differences in angular positions of 73, 73*a*, 73*b*, etc., as well as the difference in the point of tangency 66–67, etc., and most importantly, the difference in repeat lengths effective between decks. The predetermined angle includes these additive differences when the angle is registered on counter 53.

To illustrate the difference in detent position for different repeats, the following table lists various values:

TABLE

| FIG. No. | No. of Teeth | Pitch Diameter | Length of Repeat | Angular Displacement |
|---|---|---|---|---|
| 11 | 114 | 11.400 | 35.814 | 8.528 |
| 12 | 100 | 10.000 | 31.416 | 48.021 |
| 13 | 76 | 7.600 | 23.876 | 149.700 |
| 14 | 39 | 3.900 | 12.252 | 192.409 |

Two other orientations are performed on-machine prior to engagement of the various decks with the central impression cylinder 22. One has to do with the positioning of the bull gear 34 and the other has to do with the positioning of the transfer or anilox rolls 28. To better understand how these orientations fit into the overall operation, the structure and operation of a typical deck will now be explained with reference to deck 21 as depicted in FIG. 2.

As indicated previously, each deck such as the first deck 21 includes a plate cylinder 25 which bears against the cylinder 22 as well as the transfer or anilox roll 28, fountain roll 29, subframe 26 and bracket or secondary subframe 27.

An ink fountain (not shown) is mounted directly below rubber covered fountain roll 29 which simply picks up a full coating of ink for transfer to the anilox roll 28. Pneumatic cushion 78 variably urges independently driven roll 29 into contact with roll 28. In the print deck being described, secondary frame 27 housed within guides 79 can be slidably urged toward stop 80 by action of cylinder 81 through a linkage indicated in dotted line. Secondary frame 27 can be moved independent of sub-frame 26 for the purpose of disengaging roll 28 from nipping contact with roll 25 and thus, when stopping a press run, roll 25 will continue to print until it purges itself of ink. After some delay, sub-frame 26 housed within guides 82 can be slidably urged toward stop 83 by action of cylinder 84 through the linkage shown. Movement of sub-frame 26 and secondary subframe 27 thus pulls the whole complement of rolls from contact with the sub-strate W lying on the surface of cylinder 22 and hence printing stops.

A rotatable collar 85 on screw thread 86 can be positioned such that a gap 87 establishes the amount of movement effected by action of cylinder 81 through its linkage. Likewise, collar 88 on screw thread 89 establishes a gap 90 which defines the movement of subframe 26 by action of cylinder 84 through its linkage.

When the secondary frame 27 is moved outward until collar 85 is in contact with stop 87, it defines a rearward position which is used as a reference for positioning the anilox roll 28. When subframe 26 moves outward until collar 88 contacts stop 83, its outward position likewise defines a reference from which inward movement can be measured, and in this instance, refers to a plate roll positioning reference.

Since the threads per inch on screw thread 86 and the gear ratio between worm gear 91 and worm 92, etc. are all determinate, the specific angular rotation of motor 93 will produce a known and measurable inward movement of secondary frame 27.

In like manner, forward movement of sub-frame 26 can be measured and controlled by motor 94. Motors 93 and 94 are digitally controlled, and by use of conventional digit counters (not shown), the known position of secondary frame 27 and therefore roll 28, as well as sub-frame 26 and roll 25 can be defined. In like manner, knowing the distance between a given reference point and the center line of the plate roll 25, sub-frame 26 must move inwardly a specific distance from the reference point to be in nipped impression.

It will be noted that full inward motion to achieve impression cannot be achieved unless the gear teeth of gears 33 and 34 properly mesh and hence, deck positioning to full impression is a beneficial but a dependent function of proper gear mesh.

Figure 9:
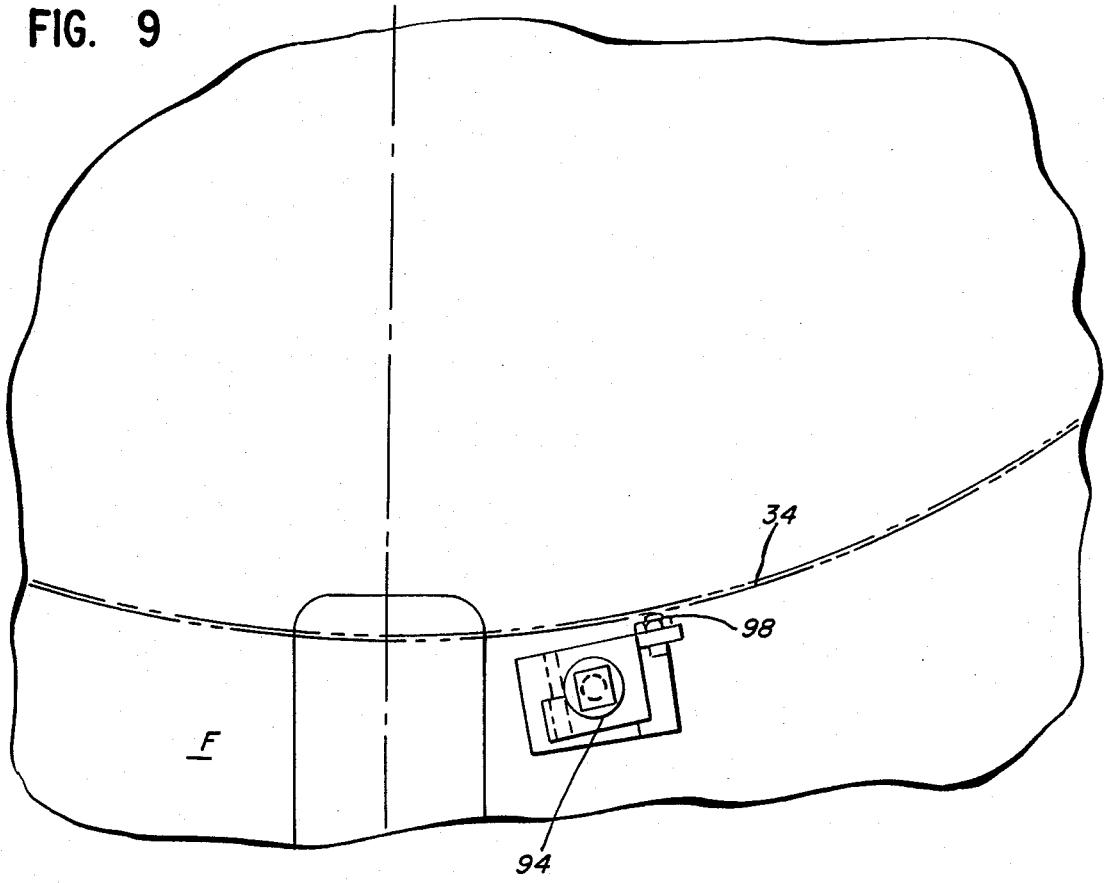
FIG. 9 is a fragmentary side elevational view of a portion of the bull gear and associated proximity switches for accurately positioning the bull gear.
Figure 10:
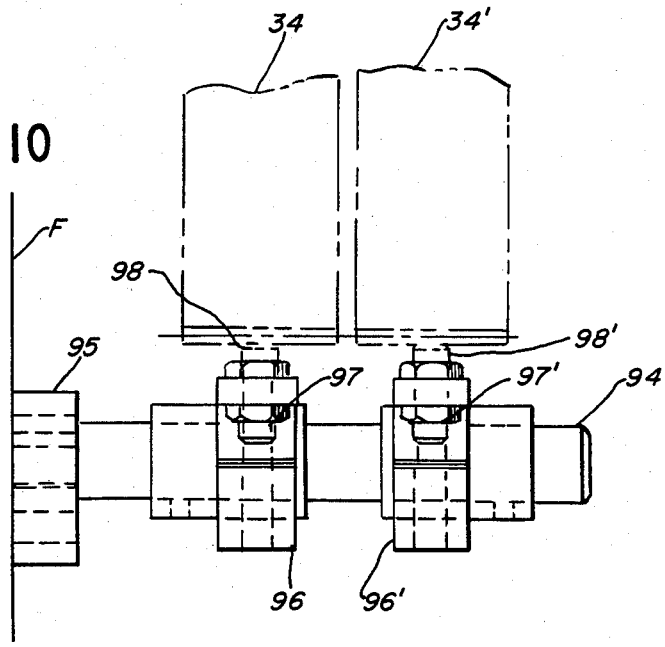
FIG. 10 is a top plan view of the proximity switches of FIG. 9.
Figure 17:
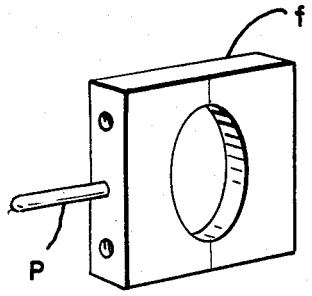
FIG. 17 is a perspective view of a device used in the setup of the machine.

Before describing FIGS. 9 and 10, reference is made to FIG. 1 and deck 21*a* which moves along line 31*a*. For initial setup of the tooth (and valley) sensing detector, a fixture f (see FIG. 17) having a horizontally extending pin P is attached to the journal of plate cylinder 25*a* and extends inwardly toward the central axis of the central impression cylinder. The tip of the pin P is shaped in gear profile and when positioned inwardly, falls at position 66 of deck 21*a*. If the pin P seats properly in a valley between two teeth of the bull gear, no further adjustment of positioning of the sensing device is required however, if the gear profiled pin does not seat properly, the sensor can be positioned and calibrated until proper meshing relationships occur as described hereinbelow.

The first of two required on-machine alignments, that is, positioning of the bull gear to receive a prepositioned tooth of the plate roll cylinder gearing, is accomplished by using the mechanisms in FIGS. 9 and 10. There, the frame F supports a horizontal shaft 94 mounted in support 95 (seen only in FIG. 10). This extends axially of the two bull gears 34 and 34' and carries brackets 96, 96' for the proximity switches 97, 97'—one for each gear.

Brackets 96, 96' holding proximity switches 97, 97' can be rotated with respect to shaft 94 and can be slidably positioned along shaft 94 so that the sensors 98, 98' of the switches 97, 97' line up with the center of the bull gears 34, 34'. Brackets 96, 96' are rotated so that a small air gap exists between sensors 98, 98' and the bull gears. When energized, the sensors will detect differences between a metallic gear tooth and the adjacent void (valley) and in this manner, they describe the edge of a gear tooth on the bull gear.

Initially, if the gauging pin, as at position 66 in FIG. 1 is not centered with a valley of the bull gear tooth, axial movement (left or right in FIG. 10) of the proximity mounting brackets 96 or 96' will cause either sensor 98 or 98' to sense either the presence of metal (top of gear tooth), or the absence of metal (valley between gear teeth). Detecting and differentiating between metal or void, this signal can be used to drive the bull gear in one direction or the other until the gauging pin at position 66 of FIG. 1 fits directly into a valley between two gear teeth of the bull gear.

In FIG. 10, it will be noted that either one or both of the brackets 96, 96' can be moved axially. Since the bull gear teeth are helical, axial movement of the bracket and associated sensor results in delivery of an electrical error signal to a hydraulic motor H (see FIG. 1) which moves the bull gear 34 very slowly until the error signal ceases. In this manner and by moving the sensors a small amount, a valley between two gear teeth can be accurately aligned with the plate cylinder gauging pin (not shown) at position 66 of FIG. 1. When a valley is accurately aligned with the gauging pin, brackets 96, 96' are lockably clamped to shaft 94 and remain fixed in this position without further need for adjustment.

Thus, after initial setup, the sensors will always generate an electrical error signal until detection of a tooth edge at the position shown in FIG. 10 results in placement of a valley between teeth in alignment with the gauging pin at position 66 of FIG. 1. It is noted that the valley between any two teeth of the bull gear establishes the necessary precondition for proper gear mesh between the bull gear and a plate cylinder gear tooth—the plate cylinder gear tooth being positioned to engage horizontally, as at 66 in FIG. 1. This is a reference position for the bull gear since deck 21*a* is used as a reference from which other angular deviations are measured. In other words, once the sensor bracket is tightened and a valley between bull gear teeth is precisely aligned for gear mesh, calculating the angles for other decks will automatically take care of differences in line of movement relative to the axis of the central impression cylinder, etc.

The second of two on-machine orientations required prior to gear engagement is that of the anilox roll gears and this will be explained in conjunction with FIGS. 15 and 16. In FIG. 16 the anilox roll is seen in a very small fragment at the extreme right hand end and is designated 28. It also is equipped with a journal as at 99 supported in a bearing generally designated 100 and provided as part of the secondary subframe 27. The journal extends beyond the bearing 100 carries a pair of gears 101 and 101' for meshing engagement with the plate cylinder gears 33 or 33', respectively. Again, these are helical gears and even though there is not the problem of register for the anilox roll 28—it can be in any orientation to transfer ink to the plate cylinder 25—there is still the problem of achieving proper gear mesh. The object, of course, is to reduce the engagement of the various cylinders to a simple lineal motion achieved by the operation of the fluid cylinders 84 and 81 (see the bottom left hand portion of FIG. 2).

Again with the geometry of the plate cylinder gear 33 being known, it is a straightforward trigonometric calculation to determine what the orientation of the anilox roll gear 101 should be for smooth meshing. Thus, for each repeat, there is a predetermined angular orientation of the anilox roll gear 101 which must be introduced into the system.

For the purpose of properly aligning the gear 101 with the gear 33, I provide a dial 102 which is affixed to the gears 101 and 101'. More particularly (here referring to the left hand portion of FIG. 16), the dial 102 consists of a plate carrying on its outer face numerals indicating degrees. The plate is bolted to a tubular member 103 which in turn is bolted to the gear support 104.

Figure 15:
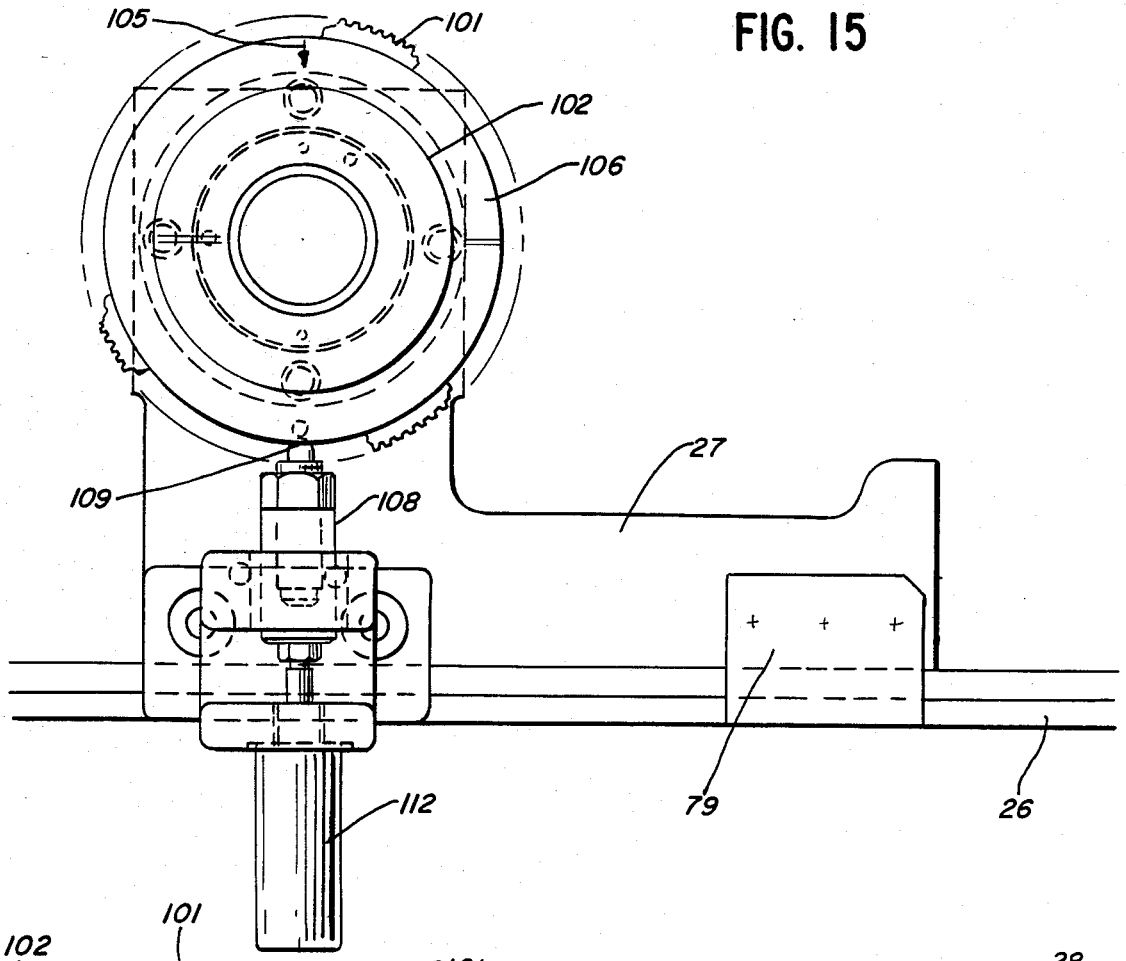
FIGS. 15 and 16 are, respectively, side and end elevational views of the portion of the print deck dealing with the anilox or transfer roll.
Figure 16:
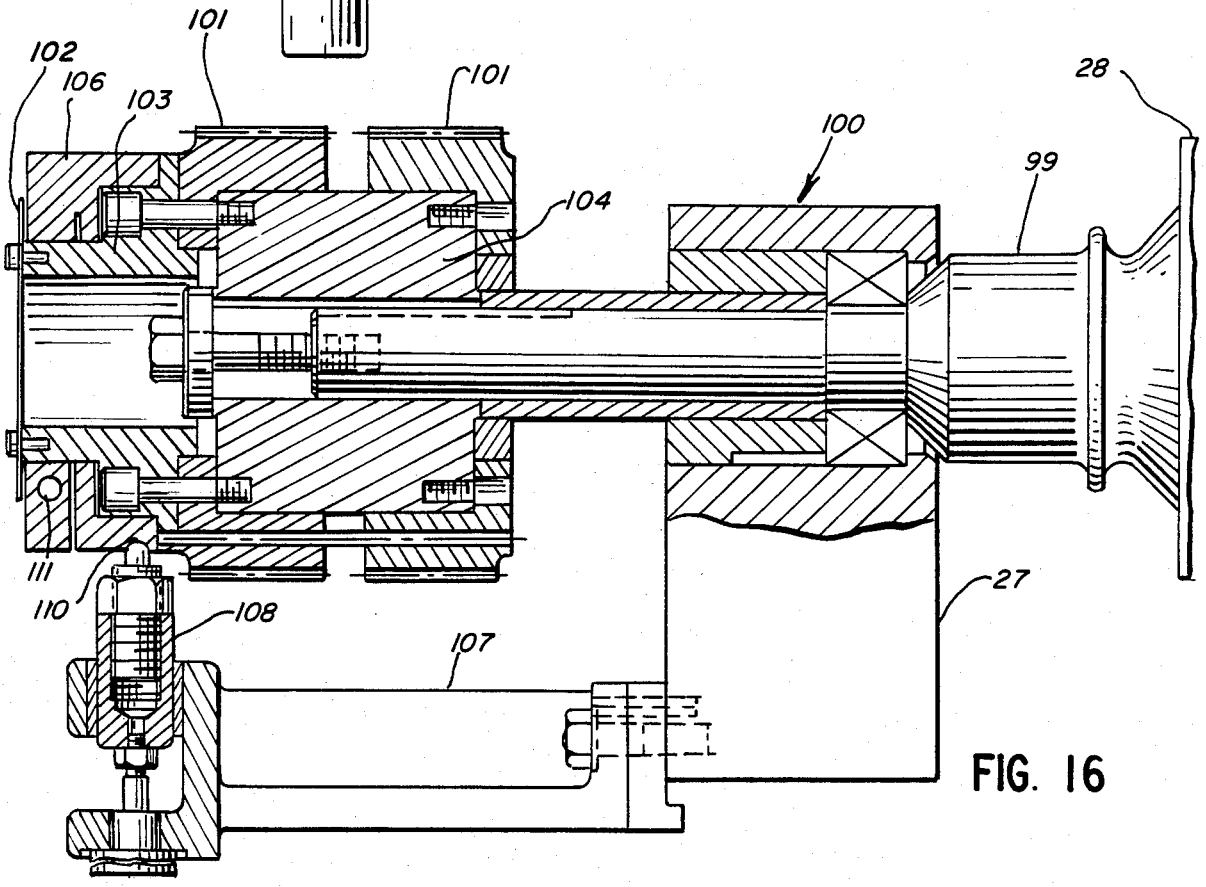

Although any gear tooth can be selected for proper mating engagement with the plate cylinder gear 33, I prefer to select a tooth which can be oriented an integral number of degrees from an indicator mark 105 at the extreme top of FIG. 15. The indicator mark 105 is carried on a split collar 106 which is rotatably mounted on the member 103. If, for example, a given repeat requires that a tooth be selected for engagement which is 13 degrees different from exact alignment of the indicator mark 105 and the zero degree dial setting, the transfer cylinder 28 is rotated until the dial setting is 13 degrees—as determined visually relative to the indicator mark 105.

If the roll is angularly positioned such that zero reading on the dial is aligned with indicator mark 105 when ball 109 is engaged in the detent 110, then angular rotation of the roll (and dial) to the predetermined angle will position a gear tooth at the same predetermined angle from the detent and, therefore place it in the proper angular relationship for gear engagement between transfer and plate roll gears. In actual operation, I provide a card for each repeat cylinder listing the anilox roll angle setting.

OPERATION

In the operation of the invention, those responsible for plate mounting are advised of a forthcoming change in repeat. They thereupon select the six appropriate plate cylinders—this while the press is operating on a previously selected repeat—and install extra register assemblies 35 on stub shaft 32' of fixture 43 for proper orientation away from the machine. More particularly, the lock bolts 65 and 76 of the collars 55 and 74 respectively (see FIG. 4) and the lock bolt 72 of the collar 68 (see FIG. 6) are loosened so as to be freely rotatable. Register assembly 35 was ensleeved on the stub shaft 32′ (see FIG. 5) with the pin 54 (compare FIGS. 3 and 4) in alignment with the keyway 42′ (see FIG. 6). The keyway 42′ is identical with the keyway 42 seen in the left hand portion of FIG. 4 and associated with the plate cylinder 25. This results in a preselected, particular tooth T of the gear 33 (see FIGS. 3 and 6) being in general alignment with the keyway 42′—and more specifically the imaginary scribe line 41 bisecting the keyways 42 and 42′.

To insure exact positioning of the preselected tooth T so that its center $T_c$ (see FIG. 3) will be centered axially of the bull gear 34 (or 34′), the hand wheel 62 is turned to elevate the gauging block 61. As the gauging block 61 or 61′ (see FIG. 5) is being elevated slowly, the gear 33 is minipulated or "jockeyed" so as to have the particular tooth T positioned squarely between the struts 63 and 64 (see FIG. 8). This is made possible by virtue of the fact that the sleeve 36—the innermost part of the register assembly 35 and which carries the gear 33—is equipped with a slot 57 through which the pin 54 extends—again see FIG. 3. When the struts 63 and 64 are at the very base of the valleys flanking the selected tooth T, the tooth T is properly centered and the lock bolt 65 is tightened so as to fix the collar 55 (still referring to FIG. 4) firmly in place on the sleeve 36. The preselected tooth T now has its center in exact alignment with the imaginary scribe line 41.

The register assemblies 35 for all plate cylinders except 25*a* associated with No. 2 Deck have to have a predetermined phase angle introduced thereinto. This stems from the difference in angular orientation of the decks as explained previously. For example, the first, third, fourth and sixth decks are so arranged that the line of movement of the rolls thereon does not pass through the point of tangency with the central impression cylinder 22 so a phase angle has to be introduced to make sure that the proper tooth on the gear 33 enters the proper valley of the bull gear 34.

To introduce this preselected angle, the gauging blocks 61, 61′ are retracted so as to free the gear 33 for rotation. Here it will be appreciated that the register assembly 35 cannot rotate relative to the stub shaft 32′ because of the engagement of the pin 54 with the keyway 42′. And, with the collar 55 firmly clamped to the sleeve 36, there is no relative rotational movement between the pin 54 and the gear 33.

To introduce the desired phase angle, the hand wheel 50 is turned until the counter 53 registers the correct angle. For example, for one selected repeat and for the No. 6 Deck, this angle is 113.2 degrees. The hand wheel 50 is then turned until this numeral is registered on the counter 53. Thereupon, the loosely mounted collar 68 (see FIGS. 3 and 6) is rotated until the detent 69 (see FIG. 3) is engaged by the ball ended shaft 70 of the plunger 71. Thereafter the lock bolt 72 is tightened to firmly clamp the collar 68 to the outer sleeve 38—the sleeves 38 and 36 being nonrotatably coupled to each other by virtue of the axial spline 37. With this manipulation performed, the preselected tooth is now at the predetermined phase angle relative to detent 69. When the register assembly is removed from the fixture 43 and installed in the press as part of a plate cylinder, the positioning of the detent will insure that the preselected gear tooth is at the same phase angle relative to the ball 70′.

For that purpose, the register assembly 35 is removed from the stub shaft 32′ of the fixture 43 and ensleeved on the plate cylinder journal 32—see FIGS. 3 and 4. More particularly, the pin 54 of the collar 55 is aligned with the keyway 42 of the journal 32 which means that the preselected tooth is now in a predetermined, fixed relationship to the plate 40 on the plate cylinder 25. Lock bolt 76 of collar 74 fixes the register assembly 35 on shaft 32. The plate 40 is now installed on the plate cylinder 25 in a predetermined relationship to the scribe line 41 so that now the plate and preselected tooth are in the necessary relationship.

To get the preselected tooth into the proper relationship with the bull gear 34, use is made of the detent 69—see FIG. 3. A counterpart ball 70′ is provided as part of the subframe 26 carrying the plate cylinder 25.

Still referring to FIG. 3, it is seen that a portion of the subframe 26 is depicted at the lower left portion thereof and which carries a bearing 113 for supporting the journal 32 of the plate cylinder. The subframe 26 also carries an arm 114 which is equipped with a counterpart ball-providing mechanism to that on the positioning fixture 43. The arm 114 has a plunger 71′ carrying the ball-ended shaft 70′ for engagement with the detent 69. The ball 70′ is urged upwardly by means of an air cylinder 115 carried by the arm 114. When the air cylinder 115 is energized, the ball 70′ rides against the outer surface of the collar 68 and, as the plate cylinder 25 is rotated, eventually comes into engagement with the detent 69. This insures that the preselected tooth is oriented at the proper phase angle relative to the preselected valley in the bull gear 34.

At this point, however, the outer sleeve 38 carrying the plate cylinder gear 33 is still frree to move axially relative to the plate cylinder by virtue of its splined connection 37 with respect to the fixed inner sleeve 36. Therefore, I provide means for limiting this axial movement and thereby position the center of preselected tooth T in alignment with the center of the mating valley of the bull gear. This can be seen in the right hand portion of FIG. 3 and includes a ball bearing 116 fixed to the end of the journal 32. This bearing 116 is "captured" by means of a half collar 117 pivotally mounted on the arm 114.

More particularly, the arm 114 pivotally carries a bracket 118 which is pivotally connected to the arm as at 119. A locking lever 120 is provided to fix the bracket in its upright position so as to capture the bearing 116. When the plate cylinder 25 has been placed within the sub-frame 26, bracket 118 is pivoted from a horizontal position into that illustrated in FIG. 3 so as to half-surround the bearing 116. If the bearing 116 is not exactly aligned with the half collar 117, it can be moved axially one way or the other by virtue of the spline connection between the collar 38 and the collar 36. This operation insures that the center of the plate cylinder gear aligns axially with the center of the bull gear. Thereafter, locking lever 120 is tightened so that this position of register assembly 35 is maintained. After this, the entire plate cylinder and the pre-locked register assembly is rotated until detent 69 is engaged by the ball ended shaft 70′ which establishes the proper rotary reference for subsequent gear mesh between the plate cylinder gearing and bull gearing and automatic color-to-color registration as the various decks are brought into nip engagement.

As a necessary precondition for proper gear mesh between the central impression cylinder gear and the plate cylinder gear, it is understood that the central impression cylinder gear must be very accurately angularly positioned. Since the gears are helical, it is therefore necessary to have a means that will always place the plate cylinder gear on the axial center of the central impression cylinder gear so that the center of the gear will always be used as a point of reference in determining that proper angular rotation exists and proper gear mesh can occur.

I provide a centering means for the plate cylinder in the form of a positioning device generally designated as 123. The device 123 includes a cam roller 124 mounted on bracket 118. A ramp 125 is provided on the half collar 117 and when cam roller 124 engages the ramp 125, valve 126 is shut off thus indicating that the piston in hydraulic cylinder 121 is in mid-position and, at mid-position of cylinder 121, collar 117 is in a predetermined position relative to the center of bull gears 34, 34'.

When the plate cylinder 25 with register assembly 35 is installed in the machine, bearing 116 resting in groove 116' of collar 117 will position the center line of the plate cylinder gears 33, 33' in coincidence with the center line of the bull gears.

If the bearing 116 is not aligned with groove 116', axial movement of coattached collar 68 and sleeve 38 will move bearing 116 into groove 116' and will place gears 33, 33' in proper axial alignment with the central impression cylinder gears 34, 34'.

Since the hydraulic cylinder is in mid stroke, it will be recognized that when the machine is running, actuation of hydraulic cylinder 121 will move helical gears 33, 33' axially right or left and hence cause a slight angular advance or retard of the bull gear 34, 34'. This is common practice and well known art.

The bull gear 34 is now rotated to a predetermined position by virtue of the sensor 98 of the proximity switch 97 sensing the correct profile of a tooth so that when the plate cylinder 25 is moved toward the central impression cylinder 22, the teeth of the gears associated with these two cylinders will mesh properly. However, before that movement takes place, the anilox roll 28 is oriented to the proper angle in the manner previously described and using the ball and detent arrangement 109, 110 described in conjunction with FIGS. 15 and 16.

According to the invention, I provide first and second alignment means on each of the press 20 and the fixture 43 for properly orienting each plate cylinder 25. The first alignment means includes the keyways 42 and 42' engaged by the pin 54. Once these have been positioned properly, the lock means in the form of collar 55 locks these elements in alignment. The second alignment means includes the detent 69 and the "balls" 70 and 70'. Once the detent 69 has been positioned in alignment while in the fixture 43, the collar 68 is locked to preserve this alignment during transfer of the register assembly 35 to the subframe 26. Thereafter, the "ball" 70' provided as part of the subframe 26 brings about the same orientation of the plate cylinder gear 33 as it was in the fixture 43.

A third alignment means is provided for each transfer or anilox roll in the form of the detent 110 and the "ball" 109—the detent 109 locked into predetermined relation with the plate cylinder helical gear 33 by means of the collar 106 (see FIG. 16).

All of the necessary preconditions for automatic gear mesh and registration between decks exist and linear movement of subframe 27 for proper transfer cylinder to plate cylinder gear engagement as well as linear movement of subframe 26 for proper gear engagement between the plate cylinder gearing and central impression cylinder gearing can now occur to complete the changeover. This occurs by handwheel or motorized rotation of shaft 92, 92' (FIG. 2) and translated rotary motion on shafts 89 and 86 for subframes 26 and 27, respectively.

Since one revolution of the shafts 92, 92' produces a fixed and determinate amount of linear movement of the subframes, the use of hydraulic motors with feedback signals to known microprocessors becomes a system for "automatic" impression, that is, based on known values for different repeats, the microprocessor will signal the hydraulic motor to move the subframes into impression positions and can determine accurately when the movement should stop.

After linear motion of the subframes is completed, subframe 27 is firmly locked against subframe 26 by cylinder 81, hence both frames are thus locked relative to the impression cylinder. Details of these lockup systems are shown in previously issued U.S. Pat. No. 3,041,967.

Figure 18:
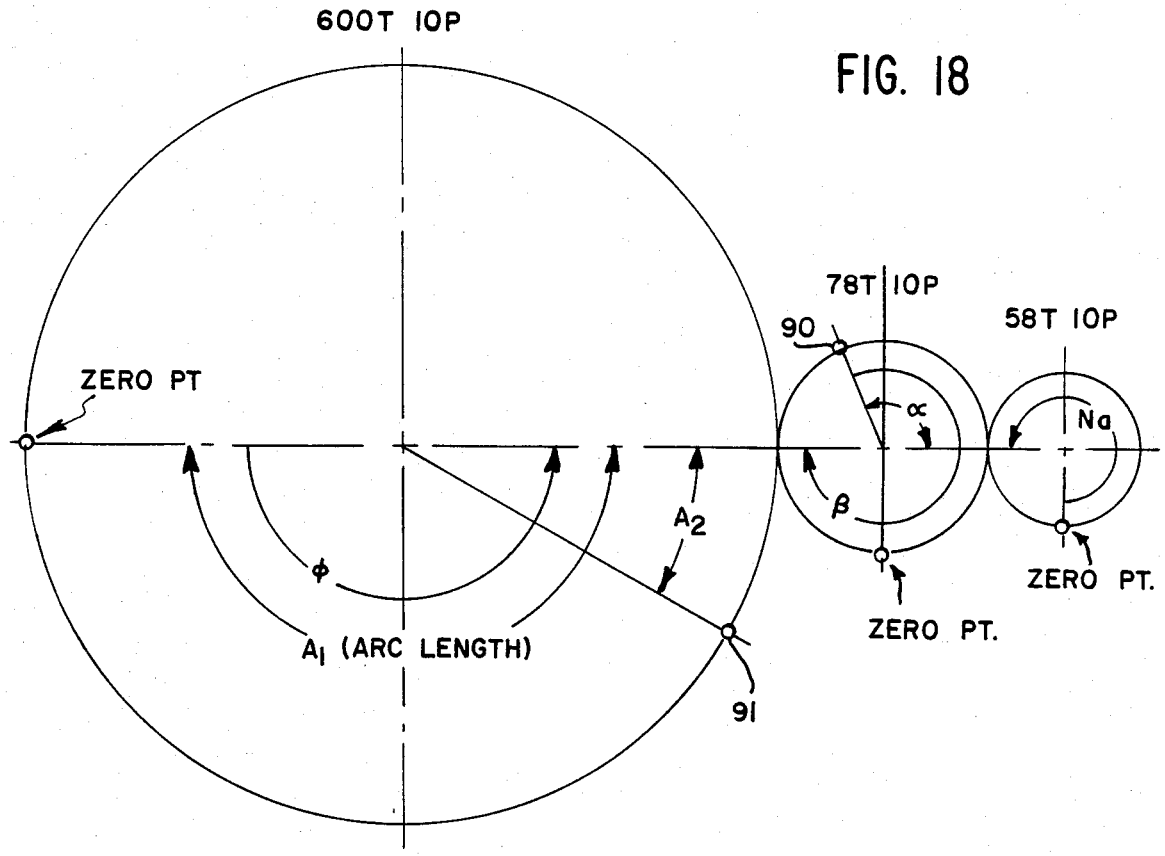
FIG. 18 is a schematic view having certain symbols applied thereto employed in computations for achieving registration.

For further explaining the best mode of practicing the invention certain trigonometric calculations are set down. In the instant calculations, a horizontal deck position was selected for simplicity (No. 2 or No. 5 deck) as can be seen in FIG. 18. Decks 1-3-4-6 involve additional mathematical formulae because the deck positions do not pass through the horizontal center line of the central impression cylinder, but such additional formulae essentially relate the other deck positions to the horizontal deck positions and are additive for only those other positions.

The calculations below essentially determine the position of the scribe line and the position of a specific gear tooth when aligning the plate cylinder to the impression cylinder, and also determine the position of a gear tooth on the anilox roll such that it will properly mate with a corresponding valley in the plate cylinder gear when the decks are brought into printing impression. In FIG. 18, certain symbols are shown as representing arc lengths, and it is understood that arcuate lengths are always taken at the periphery of the roll or cylinder. In any event, knowing the diameter of a given cylinder, arcuate lengths and angular measurements are determinate each from the other. Essentially, the angle beta ($\beta$) is expressed as an angular measurement, but it can be converted to arcuate length and would be equal to $A_2$. In essence, when point 90 on the plate cylinder is rotated through an angle beta, it will coincide with point 91 when both of these points reach and are coincident with the horizontal center line between the plate and impression cylinders.

These calculations show that certain angles on downstream decks can be pre-determined ahead of time such that automatic registration occurs as a specific point (91) is rotated around the central impression cylinder to reach various deck positions.

These calculations also show that by comparing angular rotation or arcuate lengths against the number of gear teeth involved, the anilox roll can also be rotated to a pre-determined position such that gear mesh between the anilox and plate cylinder is accomplished when the decks are activated.

---

24.504" Repeat
Plate Cylinder

-continued $\phi = 180°$ $$A_1 = \frac{\phi}{360}(2\pi R\beta) = \frac{180}{360}(2\pi \times 30) = 94.248''$$

$$A_2 = 94.248 - (3 \times 24.504) = 20.736''$$

$$\beta = \frac{20.736}{24.504} \times 360° = 304.642°$$

Anilox Roll $\alpha = 304.642° - 180° = 124.642°$ $$\frac{124.642}{360} \times 78 = 27.006 \text{ Teeth (Plate Cyl. Gear)}$$

$$N_a = \frac{270}{360} \times 58 = 43.500 \text{ Teeth (Anilox Roll Gear)}$$

$$0.500 - 0.006 = 0.494 \text{ Teeth (Out of Phase)}$$

$$\frac{0.494}{58} \times 360 = 3.066°$$

While in the foregoing specification a detailed description of an embodiment of the invention has been set down for the purpose of illustration, may variations in the details hereingiven may be made by those skilled in the art without departing from the spirit and scope of the invention.

I claim:

1. In a method of achieving rotary registration in a press having a helical gear-equipped central impression cylinder and at least two helical gear-equipped plate cylinders, the steps of:

(a) providing a positioning fixture separate from the press;

(b) sequentially mounting each plate cylinder gear on the positioning fixture;

(c) orienting each plate cylinder gear relative to a first reference on the positioning fixture which corresponds to a reference on the associated plate cylinder while the plate cylinder gear is mounted on the positioning fixture;

(d) orienting at least one of the plate cylinder gears and said first reference on the positioning fixture relative to a second reference on the positioning fixture which corresponds to a reference on the press to provide a desired phase angle between said one plate cylinder and the other plate cylinder; and (e) mounting the gear-equipped plate cylinders on the press and moving the plate cylinder gears radially into engagement with the impression cylinder gear.

2. In a method of achieving rotary registration in a press having a helical gear-equipped central impression cylinder and a helical gear-equipped plate cylinder, the steps of mounting said plate cylinder gear on a positioning fixture, orienting said plate cylinder gear relative to a first reference on the positioning fixture which corresponds to a reference on said plate cylinder while the plate cylinder gear is on the positioning fixture, orienting said plate cylinder gear and the first reference on the positioning fixture relative to a second reference on the positioning fixture which corresponds to a reference on the press, installing said plate cylinder gear on said press, and after installing said plate cylinder gear in said press, moving the said plate cylinder gear radially into engagement with the central impression cylinder gear.

3. A method of achieving register in a printing press having a central impression cylinder equipped with a gear, and a plurality of plate cylinder assemblies disposed circumferentially about the impression cylinder, each of the plate cylinder assemblies including a plate cylinder having a shaft and a reference point, and a register assembly mounted on the shaft, each of the register assemblies including a plate cylinder gear and first alignment means for positioning a gear tooth of the plate cylinder gear with respect to the reference point of the plate cylinder, the printing press having second alignment means for each of said plate cylinder assemblies for positioning a tooth of each plate cylinder gear with respect to the impression cylinder gear, comprising the steps of:

(a) providing a positioning fixture separate from the printing press, the positioning fixture having a shaft corresponding to the shaft of each of said plate cylinders, a reference point corresponding to the reference point on each of said plate cylinders, and third alignment means corresponding to each of the second alignment means on the printing press, (b) sequentially mounting each register assembly of said plate cylinder assemblies on the shaft of the positioning fixture, (c) orienting the first alignment means of each register assembly while it is mounted on the shaft of the positioning fixture to position the first alignment means with respect to the reference point on the positioning fixture, (d) orienting the plate cylinder gear of each register assembly while it is mounted on the shaft of the positioning fixture to position a preselected tooth of the plate cylinder gear into alignment with the reference point on the positioning fixture, (e) orienting the reference point on the positioning fixture relative to the third alignment means on the positioning fixture while each register assembly is mounted on the fixture to provide a different angular relationship between the reference point on the positioning fixture and the third alignment means for each register assembly, (f) removing each register assembly from the positioning fixture and mounting the register assembly onto one of said plate cylinders to form a plate cylinder assembly, (g) mounting said plate cylinder assemblies on the printing press, (h) rotating each of the plate cylinder assemblies with respect to the second alignment means on the printing press for that plate cylinder assembly until the reference point of that plate cylinder assembly has the same angular relationship with the second alignment means on the press as it had with the third alignment means on the positioning fixture, and (i) moving the plate cylinder assemblies toward the impression cylinder so that the plate cylinder gears mesh with the impression cylinder gear.

4. The method of claim 3 including the step of orienting the impression cylinder gear before the plate cylinder gears mesh with the impression cylinder gear so that a valley between gear teeth of the impression cylinder gear is centered with respect to said preselected tooth of one of the plate cylinder gears.

5. The method of claim 3 in which said reference point on each plate cylinder is provided by a stop on the shaft of the plate cylinder, the first alignment means of each of the register assemblies including positioning means engageable with a stop on the shaft of a plate cylinder, the reference point of the positioning fixture being provided by a stop on the shaft of the positioning fixture corresponding to the stops on the shafts of the plate cylinders, including the steps of engaging the positioning means of each register assembly with the stop on the shaft of the positioning fixture when the register assembly is mounted on the positioning fixture, and engaging the positioning means of each register assembly with the stop on the shaft of the associated plate cylinder when the register assembly is mounted on the associated plate cylinder.

6. The method of claim 3 in which said printing press includes a coacting transfer cylinder assembly for each of said plate cylinder assemblies, each of the transfer cylinder assemblies including a transfer cylinder and a transfer cylinder gear, including the step of orienting each transfer cylinder gear relative to the associated plate cylinder gear, and moving the transfer cylinders toward the plate cylinders when the plate cylinder assemblies are moved toward the impression cylinder so that the transfer cylinder gears mesh with the plate cylinder gears substantially simultaneously with the meshing of the plate cylinder gears with the impression cylinder gear.

7. The method of claim 6 in which the printing press includes fourth alignment means for each transfer cylinder assembly, each transfer cylinder gear being equipped with detent means, including the step of orienting the detent means of each transfer cylinder gear into alignment with the fourth alignment means associated with the transfer cylinder gear to position a preselected gear tooth of the transfer cylinder gear relative to the associated plate cylinder gear.

8. The method of claim 3 in which each said register assemblies includes a sleeve which can be mounted on the shaft of one of the plate cylinders, the plate cylinder gear of each register assembly being mounted on the sleeve of the register assembly, a collar surrounding the sleeve, the first alignment means of each register assembly comprising a pin extending through the collar and through a circumferentially elongated slot in the sleeve, the reference point of each plate cylinder being provided by a stop on the shaft of the plate cylinder, the reference point of the positioning fixture being provided by a stop on the shaft of the positioning fixture corresponding to the stops on the plate cylinder shafts, including the step of engaging the pin of each register assembly with the stop of the positioning fixture when the register assembly is mounted on the shaft of the positioning fixture, said step of orienting the plate cylinder gear of each register assembly comprising rotating the sleeve and the plate cylinder gear of the register assembly with respect to the pin and the stop of the positioning fixture and then locking the collar on the sleeve to prevent relative rotation between the sleeve and the pin.

9. The method of claim 8 in which each of the register assemblies includes a second collar rotatably mounted on the sleeve, the second collar having a detent engageable with the third alignment means of the positioning fixture, said step of orienting the third alignment means comprising the steps of rotating the shaft of the positioning fixture and the sleeve of the register assembly to a preselected angle, rotating the second collar with respect to the sleeve until the detent on the collar engages the third alignment means, and locking the second collar on the sleeve to prevent relative rotation between the second collar and the sleeve, said step of rotating each of the plate cylinder assemblies with respect to the second alignment means on the printing press for that plate cylinder assembly comprising rotating each plate cylinder assembly until the detent on the second collar of the plate cylinder assembly engages the second alignment means.

10. The method of claim 3 in which each of the register assemblies includes a collar rotatably mounted on the sleeve, the collar having a detent engageable with the third alignment means of the positioning fixture, said step of orienting the third alignment means comprising the steps of rotating the shaft of the positioning fixture and the sleeve of the register assembly to a preselected angle, rotating the collar with respect to the sleeve until the detent on the collar engages the third alignment means, and locking the collar on the sleeve to prevent relative rotation between the collar and the sleeve, said step of rotating each of the plate cylinder assemblies with respect to the second alignment means on the printing press for that plate cylinder assembly comprising rotating each plate cylinder assembly until the detent on the collar of the plate cylinder assembly engages the second alignment means.

11. A positioning fixture for a register assembly which is adapted to be mounted on the journal of a plate cylinder of a flexographic press, the register assembly including a gear and a detent, the positioning fixture comprising:

(a) a base,
(b) a pedestal on the base,
(c) a shaft rotatably mounted on the pedestal and adapted to support the register assembly,
(d) lock means on the shaft for preventing relative rotation between the shaft and the register assembly,
(e) gear stop means movably mounted on the base and engageable with the gear of the register assembly for positioning a preselected tooth of the gear relative to the lock means, and
(f) alignment means on the base engageable with the detent of the register assembly after rotation of the shaft and the register assembly for providing an angular relationship between the detent and said preselected tooth.

12. The structure of claim 11 in which said fixture includes counter means for determining the angular orientation between the lock means on the shaft and the alignment means.

13. The structure of claim 11 in which said gear stop means includes a gauging block engageable with the gear of the register assembly for accurately positioning said preselected tooth with respect to said lock means on said shaft.

14. The structure of claim 11 in which said lock means comprises a keyway on the shaft.

15. A method of pre-aligning a register assembly for a printing plate cylinder in an off-machine fixture, the register assembly including a shaft, a plate cylinder gear surrounding the shaft, first locking means for locking the plate cylinder gear to the shaft, a collar mounted on the shaft, and second locking means for locking the collar on the shaft; the fixture including a cylindrical stub shaft sized to receive the shaft of the register assembly, a first reference on the stub shaft, and a gear tooth gauge block; comprising the steps of:

(a) mounting the register assembly on the fixture by inserting the shaft of the register assembly into the stub shaft of the fixture;

(b) positioning the shaft of the register assembly relative to the first reference on the stub shaft;

(c) engaging the gear tooth gauge block with a gear tooth on the plate cylinder gear of the register assembly;

(d) locking said first locking means so that said gear tooth of the plate cylinder gear is fixed on the shaft relative to the gear tooth gauge block and to said first reference;

(e) disengaging the gear tooth gauge block from said gear tooth;

(f) rotating the stub shaft of the fixture and of the shaft and the plate cylinder gear of the register assembly through a predetermined angle;

(g) rotating said collar on the shaft of the register assembly and positioning a reference on the collar with respect to a second reference on the fixture; and (h) locking said second locking means so that the collar is fixed on the shaft relative to the second reference, whereby said gear tooth of the plate cylinder gear is aligned with said first reference and is at a predetermined angle from said second reference.

* * * * *